US010035073B2

(12) United States Patent
Bergan

(10) Patent No.: US 10,035,073 B2
(45) Date of Patent: Jul. 31, 2018

(54) TOY RACE CAR TRACKS

(71) Applicant: Brent Bergan, Alameda, CA (US)

(72) Inventor: Brent Bergan, Alameda, CA (US)

( * ) Notice: Subject to any disclaimer, the term of this patent is extended or adjusted under 35 U.S.C. 154(b) by 250 days.

(21) Appl. No.: 14/993,414

(22) Filed: Jan. 12, 2016

(65) Prior Publication Data

US 2016/0220916 A1 Aug. 4, 2016

Related U.S. Application Data

(60) Provisional application No. 62/103,212, filed on Jan. 14, 2015, provisional application No. 62/250,200, filed on Nov. 3, 2015.

(51) Int. Cl.
*A63H 18/02* (2006.01)
*A63H 33/16* (2006.01)

(52) U.S. Cl.
CPC ..... *A63H 18/02* (2013.01); *A63H 33/16* (2013.01)

(58) Field of Classification Search
CPC ..... A63H 18/00; A63H 18/02; A63H 18/04; A63H 18/06
See application file for complete search history.

(56) References Cited

U.S. PATENT DOCUMENTS 3,735,923 A 5/1973 Brigham et al.
6,467,209 B1 * 10/2002 Vickers ..... F21V 1/22 40/617
7,770,811 B2 * 8/2010 Belding ..... A63H 18/021 104/53
8,608,527 B2 12/2013 O'Connor et al.

* cited by examiner

*Primary Examiner* — Robert J McCarry, Jr.
(74) *Attorney, Agent, or Firm* — Gary Baker; QIPLG

(57) ABSTRACT

Racetracks for toy cars include structures formed from sheets of foldable material. Tracks include path channels supported by structures of triangular cross-section for mounting on room walls. Kits include planar sheets of material with lines or creases directing fold locations to fabricate a track from the sheets.

37 Claims, 12 Drawing Sheets

TOY RACE CAR TRACKS

CROSS-REFERENCE TO RELATED APPLICATIONS

This application claims priority to and benefit of a prior U.S. Provisional Application No. 62/103,212, filed Jan. 14, 2015, and 62/250,200, filed Nov. 3, 2015, by Brent Bergan. The full disclosure of the prior application is incorporated herein by reference.

FIELD OF THE INVENTION

Tracks suitable for directing rolling objects. The tracks can be printed and folded from sheets of suitable materials for mounting on walls or horizontal surfaces to prepare a track for racing toy cars.

BACKGROUND OF THE INVENTION

It is entertaining and educational to observe the progress of objects rolling on a track. In particular, children enjoy rolling toy cars on tracks representing a road. For example, see the Looped Traffic Accessory, U.S. Pat. No. 3,735,923, to Emerson. The plastic race track uses gravity to accelerate small scale toy cars down a track. The track includes loops and jumps. The tracks are premade of plastic and are connected to each other with track connectors. These systems are fun and provide some insight concerning the physics of motion. The track segments are identical in appearance.

In another toy car track, Wall Mounted Toy Track Set, U.S. Pat. No. 8,608,527, to O'Connor, a special mounting system is used to mount plastic channel tracks on a wall. The mounting devices localize the load at a small number of mounting brackets along the wall surface. Such track systems do not permit track construction beyond the specific configurations sold retail due to their complex nature. The systems are inflexible in installation on vertical surfaces.

The present inventor notes prefabrication of the tracks in factory molds and extruders means the children to miss out on the fun and learning of building their own track. Also, notable is that the materials in these old art systems are not degradable. In view of the above, a need exists for degradable tracks with more diverse appearance and allowing for diverse track construction. It would be desirable for children to have a more hands-on experience of fabricating their own track systems Further, benefits can be obtained with mounting systems that are simpler and spread the load more evenly on wall surfaces. The present invention provides these and other features that will be apparent upon review of the following.

SUMMARY OF THE INVENTION

The present inventions include tracks for rolling objects, kits for making the tracks, and methods of assembling the tracks. The tracks can be configured for mounting on a wall or can be supported by a horizontal surface. The tracks can be assembled by folding sheets of material into structures providing a channeled road surface, e.g., to receive moving toy cars.

The toy vehicle tracks have length dimension along the path and a cross-section across the path length. When viewed in a cross-section perpendicular to the path length, one can see a top channel cross-section comprising a first sidewall, the path, and a second sidewall. The sidewalls (track rails) are directed substantially perpendicular up from the path surface cross-section. One can also see a bottom triangle (or offset triangle, v-shaped structure or angled diagonal intersection with the extension) cross-section structures configured to support the path and adapted for mounting the path on the wall of a room. The bottom triangle cross-section includes path layer(s), an extension down from the first sidewall, and a diagonal running from the extension to an intersection of the path surface and the second sidewall.

In typical embodiments, the track is configured to functionally receive 1:64 scale model cars. The track can have a path surface cross-section perpendicular to the length of about 1.3 inches (3.3 cm), or about 4 cm. The track segment length dimension is about 11 inches (28 cm to about 34 cm). Each track segment can typically be fabricated from a paper sheet, such as 8.5 by 11 inch stock or A4 sheet. Alternately, a preferred dimension comprises a track length of about 14 inches (e.g., 13.96 inches).

A track for wall mounting can include any of a variety of structural features. As viewed on a sheet before folding into a track, there are a series of rectangular zones, e.g., in the order: diagonal, outer second sidewall, inner second sidewall, path surface, inner first sidewall, outer first sidewall, and extension (or circular iteration thereof). In many cases the outer first sidewall and extension comprise a single zone, not intended to be creased or folded. The order includes embodiments wherein the extension is adjacent and continuous with the diagonal, while the start and end (edges) of the order can be between any other two adjacent zones. That is, the sequence can be considered circular, with the beginning or end edge of the sheet being between any of the adjacent zones. In optional embodiments, the sheet edge can even be within a zone, splitting the circle within one of the rectangular zones. Additional zones can be included, e.g., to provide for double layered structures at more than just the walls, e.g., with additional inside diagonal, inner path, and/or inner extension layers. For example, the sheet can include nine zones: wherein the sheet of paper comprises the zones in the order of: diagonal, outer second sidewall, inner second sidewall, top path surface, inner first sidewall, outer first sidewall, extension, inner diagonal, inner path, and inner extension. In other embodiments, the listed elements can be included in 2 or three separate sheets, e.g., to be laminated at contact surfaces to form the track structure.

A track for regular mounting, e.g., dangling from a table, or supported on a horizontal surface, can be in the form of interconnectable channels. For example, toy vehicle track can have a path surface length dimension and a cross-section across the path length. The cross-section can comprise 1) a top channel cross-section comprising in order a cross-section of a first sidewall, the path, and a second sidewall, wherein the sidewalls are directed substantially perpendicular up (or tilted slightly out) from the path surface cross-section, 2) a bottom connector slot comprising the cross-section of the path surface, a continuation down from the first sidewall, a continuation down from the second sidewall, and a path bottom running from the bottom of the first and second continuations, and 3) a connector adapted to fit within the connector slot. The continuations can provide just enough space between the path and path bottom to provide a slot of appropriate size to functionally receive the connector. Optionally, one or more path surface can include an extension to overlap or underlap the path surface of the next track section.

In a common embodiment, the track cross-section walls are about 1 cm high, the path about 3.7 cm wide, the extension from about 2 cm to 5 cm, and the diagonal about 4 cm to 5.2 cm.

The track can be provided for assembly in the form of pre-creased (and/or pre-cut) sheet. The track pre-creases can be between any adjacent zones. The creasing usually excludes the intersection between the outer first sidewall and extension from the first sidewall, to enhance the strength of this mounting feature. Optionally, indicator lines can be used instead of (or with) creases to show where folds should be made.

After folding, the track zones are often adhered together at certain contact surfaces. For example, typical adhered surface pairs are: first outer wall/first inner wall, second outer wall/second inner wall, diagonal/inner diagonal, extension/inner extension, and path/inner path. In many cases, the contact between the two path layers is not fully adhered together, leaving a slot therebetween to receive a track connector. The tracks can also include a releasable (optionally permanent) adhesive on the outer surface of the first wall or on the extension of the first wall to mount the track on a room wall.

The present inventions also include kits for constructing toy vehicle tracks. The kits can include one or more planar sheets having a length greater than a width (optionally, length equal or less than width) and comprising at least 6 parallel rectangular zones running along the length. The zones can be demarked, e.g., by creases, perforations, or lines. The first rectangular zone (e.g., inner first sidewall) can have a first width, a second zone (path) a second width greater than the first width, third (inner second wall) and fourth (outer wall) widths about the same (or more) as the first width, a fifth (diagonal) width greater than the second width; and, a sixth (extension) width may vary in width to functionally link the first wall with the diagonal. The kit can include an adhesive capable of sticking to a surface of the one or more sheets.

The kit sheets can be made of (e.g., foldable sheet materials) paper, metal, plastic, and/or the like. In a convenient embodiment, the sheets have standard 8.5×11, card stock, or A4 paper dimensions. At manufacture scale, much larger sheets of card stock can be used, e.g., to punch or cut out several track layouts from one sheet.

The kit sheets can include at least 6 rectangular zones including in order diagonal, outer second sidewall, inner second sidewall, path surface, inner first sidewall, outer sidewall, and extension (the sheet can include, e.g., 5 zones if the extension and outer first sidewall are considered one zone, e.g., with no cut or crease between). In many cases, 1) the outer second sidewall, inner second sidewall, inner first sidewall, outer sidewall have a relative width dimension of about 1 unit; 2) the diagonal has a relative width dimension ranging from about 4 to 6 or 5.2 units; 3) the path has a relative width ranging from about 3 to 4 units; and, 4) the extension has a relative width ranging from about 1.5 to 3 units. In some embodiments, the outer second side wall can include an extension down, e.g., below the path level, before intercepting the diagonal, e.g., increasing its ratio about 100%.

In other typical embodiments, the sheets can include, or consist of, 9 rectangular zones including in order diagonal, outer second sidewall (optionally including an extension down), inner second sidewall, path surface, inner first sidewall, outer sidewall, extension, inside diagonal, inner path, and inner extension. Width or cross-sectional dimensions can be such that 1) the outer second sidewall, inner second sidewall, inner first sidewall, and outer first sidewall each have a relative width dimension of about 1 unit; 2) the diagonal and inside diagonal have relative width dimensions ranging from about 4 to 5.2 units; 3) the path and inner path have relative widths ranging from about 3 to 4 units; and, 4) the extension and inner extension have relative widths ranging from about 1.5 to 3 units.

The sheets for the kits can include zones as recited above, but wherein the order is circular and the sheet edge lies between (or even within) different zones. For example, the first and last listed zones can be attached (e.g., not cut or end edges) and the order of zones starts and ends at a line between any other pair of adjacent zones. In many cases the first listed zone begins at a sheet edge and the last zone ends at the opposite sheet edge. The sheets can have creases (e.g., structurally weakened lines) between any adjacent zones (often excluding the intersection between the outer first sidewall and extension from the first sidewall) to aid in assembly of a track from the sheet.

The kits can include one or more adhesives, for separate application, or preplaced on the sheets. The adhesive can be on the sheets, e.g., at contact surfaces selected from the list consisting of: first outer wall/first inner wall, second outer wall/second inner wall, diagonal/inner diagonal, extension/inner extension, and path/inner path.

The kits can include one or more track connectors adapted to connect a distal end of a first track to a proximal end of a second track. Track connectors can be received in slots between inner and outer layers of any structure element. For example, contact surfaces between the inner path and path can be left unadhered, providing a slot adapted to receive a track connector. Optionally, track segments for wall mounting can be connected with cylinders or triangular rods fit closely in the triangular space formed by the path, extension and diagonal. Optionally, connectors are not used. Optionally, any gap between track sections is traversed, e.g., using track path extensions that overlap (under or over) the path of an adjacent track section.

Tracks can be wall mounted. For example, the kits can include a releasable adhesive on the outer surface of the first wall or extension of the first wall. Releasable adhesives can be removed without tearing the adhered surfaces. Typically, the releasable adhesives are adapted to cleanly release under certain conditions, without leaving residue on the contact surfaces. Exemplary releasable adhesives include GLU-DOTS™, COMMAND STRIP™, and/or the like. Optionally, the wall mounting means includes provision of a magnet to hold the track on a magnetically interacting, e.g., metal wall.

The kit can include ways to add graphics to the sheets. The kits can include stickers. In a preferred embodiment, the sheets have dimensions compatible with printers, and the printers can be directed to apply graphics (such as colors, lines, textures, indicia) to the sheet surface. The kit can include software for designing and appropriately directing printing of graphics onto the sheets, e.g., for a custom outer appearance for the tracks.

The inventions include methods of preparing a toy vehicle track. Typically sheets are folded into vehicle paths incorporating supporting structures. The folded structures can be stabilized with adhesives and/or push tabs, connected together and mounted to prepare a long track for rolling wheels, balls, or cylinders, e.g., toy cars. The methods include the step of providing one or more planar sheets having a length greater than a width and comprising at least 6 parallel rectangular zones running along the length; wherein the zones are demarked by creases or lines; wherein in order a first rectangular zone (inner first wall) has a first width, a second zone (path) has a second width greater than the first width, third (inner second wall) and fourth widths are about the same as the first width, a fifth width is greater than the second width. The sheets can be folded along the creases or lines to fabricate a desired type of track. The tracks and sheets can have the specifications described herein.

The methods can include printing indicia and graphics onto the sheets. Adhesives can be applied to the sheets, as described herein. The tracks can be mounted to a wall, dangled from a ledge, run around a 90° corner, 360° circle, and/or supported on a horizontal surface to lay out a track for directing the progress of a rolling toy car.

DEFINITIONS

Before describing the present invention in detail, it is to be understood that this invention is not limited to particular devices or toy systems, which can, of course, vary. It is also to be understood that the terminology used herein is for the purpose of describing particular embodiments only, and is not intended to be limiting. As used in this specification and the appended claims, the singular forms "a", "an" and "the" can include plural referents unless the content clearly dictates otherwise. Thus, for example, reference to "a surface" can include a combination of two or more surfaces; reference to "sheets" includes mixtures of sheets, and the like.

Unless defined otherwise, all technical and scientific terms used herein have the same meaning as commonly understood by one of ordinary skill in the art to which the invention pertains. Although any methods and materials similar or equivalent to those described herein can be practiced without undue experimentation based on the present disclosure, preferred materials and methods are described herein. In describing and claiming the present invention, the following terminology will be used in accordance with the definitions set out below.

As used herein, directional terms, such as "upper", "inner", "outer", "lower", "top", and "bottom" are as in common usage, e.g., from the orientation of a track disposed with the track path surface up to functionally receive, e.g., a rolling toy car. Height, width, and depth dimensions are according to common usage, e.g., with reference to a track path major plane in a horizontal attitude. Length is the long dimension of the tracks along which a toy car is intended to roll. The track "cross-section" is as used in the art, the view of a track cut in a plane perpendicular to the long axis (length) of the track.

A fold is a bend in a sheet along a line. Folds can produce any functional angle, e.g., from about 1° to 180°. Folds between two track walls are often 180°, so the wall zones fold back on each other to form a double layered laminated structure. Folds between walls and paths are often about 90°; or angled out a little, e.g., to about a 110° angle. Folds and intersections between diagonals and first wall extensions or paths typically provide a less than 90° bend in the track material (e.g., as necessary to provide a structural connection).

As used herein, "substantially" refers to largely or predominantly, but not necessarily entirely, that which is specified.

The term "about", as used herein, indicates the value of a given quantity can include quantities ranging within 10% of the stated value, or optionally within 5% of the value, or in some embodiments within 1% of the value.

A "crease" it a weakened line in a sheet, e.g., caused by folding, perforating, partially cutting, or crushing, e.g., along the line. An "edge" is as known in the art; e.g., the final extent of a sheet plane, e.g., a cut edge of a paper. "Lines" are visible linear markings on a sheet, as known in the art.

BRIEF DESCRIPTION OF THE DRAWINGS

FIG. 3A shows a cross-section of a track assembled from three separate sheet segments. FIG. 3B shows a cross-section of a track with mostly single layer structures.

FIG. 3C shows a cross-section of a track employing double sheet layers for structural elements.

FIG. 4A shows a cross-section of a bilaminar track. FIGS. 4B and 4C show cross-sections of trilaminar tracks.

FIG. 6C shows a cross-section of a track assembled based on the layout presented in sheets 6A and 6B.

In FIG. 8A, the un-folded track is laid out with the back side oriented up and the front (e.g., visible, indicia printed) side down. At 8B, the track is partially pre-folded so at the creases between inner walls and path bringing them closer together on the front side and other zones are folded at creases to bring them closer together on the back side. At 8C, adhesive backing tape is removed to allow the inner walls to be adhered to the outer walls. At 8D, the walls (rails) are formed by pressing the inner and outer walls together so they become laminated with the exposed adhesive. At 8E and 8F, the track is folded into the final shape and tabs inserted into slots. Finally, at 8G, the aligned push tabs are pushed through to the inside of the track so that the external push tab is locked into the void left by the removal of the inner push tab.

FIG. 10A shows a cross-sectional (or end on) view. FIG. 10B is a top down view of an assembled curved track. FIG. 10C shows a bottom view of the assembled curved track.

DETAILED DESCRIPTION

Figures 1, 2:
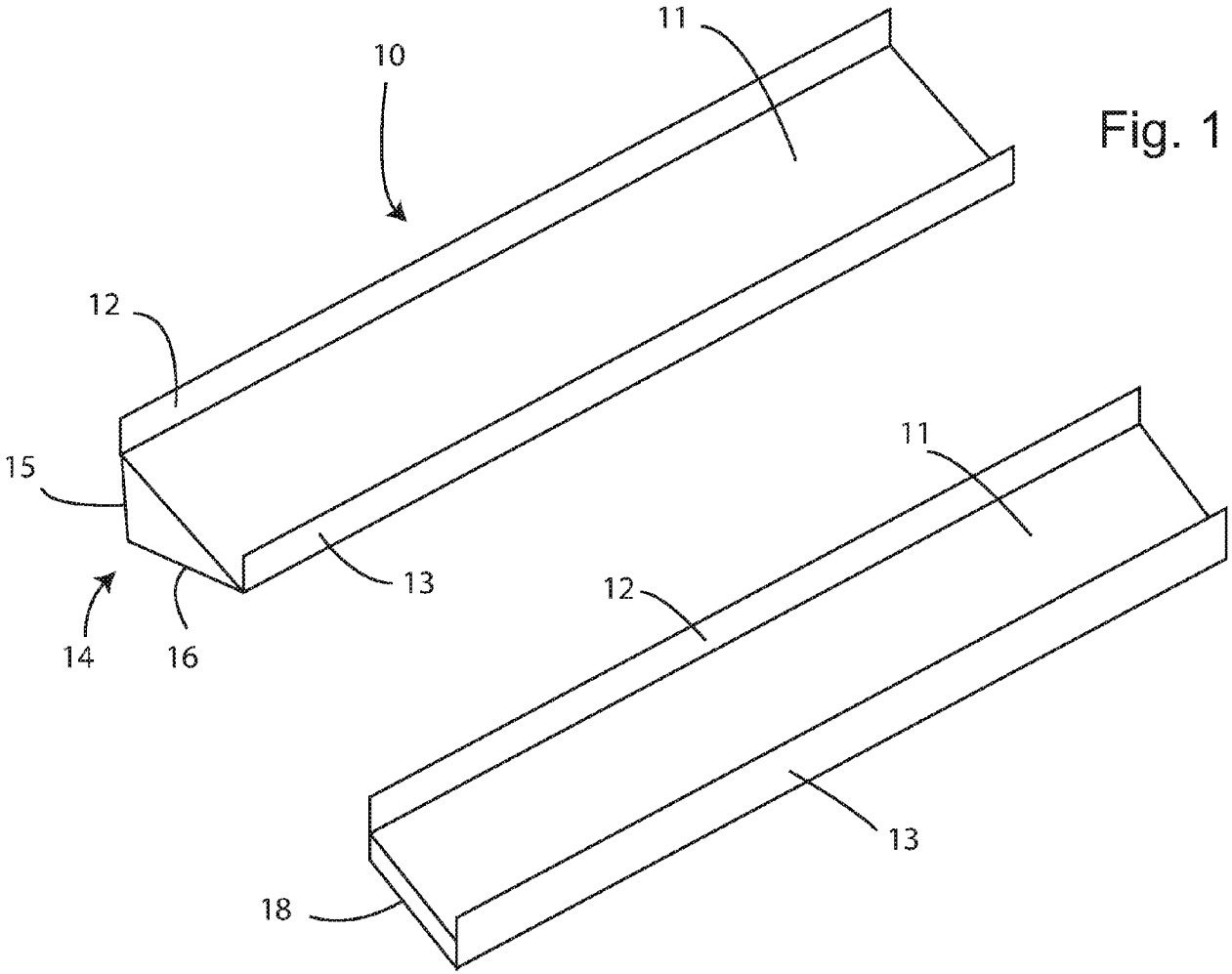
FIG. 1 is a schematic diagram of an exemplary track adapted to be mounted on a room wall.
FIG. 2 is a schematic diagram of an exemplary track intended for layout on a generally horizontal surface, or dangled from a ledge.

The present inventions include, e.g., toy car tracks, kits to make tracks, and methods of assembling and using tracks. Tracks for wall-mounted use can include a path of certain length and having a cross-section with a channel supported by, e.g., a triangular brace. Flat tracks can have a channel cross-section including path top and bottom layers separated by a gap capable of receiving a connector adapted to join one track segment to another. The tracks can be assembled, e.g., from printed and creased standard card stock. Methods can include, e.g., folding sheets having designated zones and adhering thus laminated zone surfaces to provide sturdy attractive tracks for toy cars Tracks A typical track 10 of the invention includes a longitudinal racetrack path 11 bounded by retaining walls 12 and 13 on each side. The racetrack channel is supported by structural members that, e.g., enable mounting of the track, attaching one track to the next, and for stiffening the track. Cut outs or pleats can be utilized in the tracks to provide for curving tracks.

The tracks have a pathway configured to channel a toy car, typically energized by gravity. A single track segment path has a length from about 3 cm to 3 meters, from 5 cm to 1 meter, from 10 cm to 500 cm, from 15 cm to 200 cm, from 20 cm to 100 cm, from 25 cm to 50 cm, or about 28 cm. In a convenient embodiment, the length of a single track segment is the same as a standard sheet of construction material, such as a standard card stock or printing paper stock. For example, the track is often the length of conveniently available standard printable stock, such as an 8.5×11 inch paper or A4 paper length or width dimension.

A track path has a width suitable for the channeling of a moving toy car of interest. The path is the surface intended for contact of car wheels during rolling movement. Typically the track path is as wide as the intended car to more than 1.5-fold as wide, from 1.2-fold as wide to 1.05-fold as wide, or about 1.1-fold as wide as the intended car or rolling object. For example, the path can have a width to allow free movement of a generic toy car (typically 1:64 scale cars), or another toy car of interest. The path width can range from about 1 cm to 1 meter, from 1.5 cm to 500 cm, from 2 cm to 100 cm, from 2.5 cm to 20 cm, from 3 cm to 10 cm, or about 3.7 cm.

The track path and bordering walls (rails) form a channel that retains and directs the cars as they roll down the path. The walls typically run the length of the path and rise to a height adequate to retain the toy cars of interest within the channel as they roll down the track, e.g., about half the height of the wheels. The walls typically have a length about the same as the length of the track path. The walls can range in height from about 1 mm to 500 cm or more, from 1.5 mm to 50 cm, from 2 mm to 10 cm, from 4 mm to 2 cm, from 7 mm to 15 mm, or about 1 cm. The walls can intersect the path at 90° or tilt slightly (45° to 0°, 20° to 10°, or about 15°) in or preferably out.

Figure 10A:
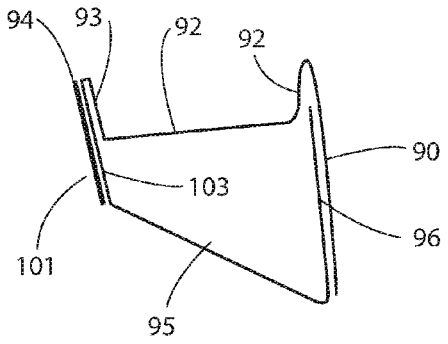
FIGS. 10A to 10C show views of an exemplary assembled curved track using cut outs on the inside of the curve to allow a shorter path on the inside of the track.

In tracks intended for room wall mounting (as shown in FIG. 1), the track path channel (walls and path) are supported by a support structure. The support structure is adapted, e.g., to provide points on a surface for a mounting interaction with the room wall, and to support the path 11 in an orientation facilitating stable travel of a car down the track. For example, the lower support structure 14 can include an extension 15 down from the wall intended to be nearest the room wall, a diagonal 16 member extending from the extension to the underside of the road path member(s), and/or a planar member (inner path, FIG. 3C) 17 running along the underside of the top channel path. The support structure (e.g., bottom triangle or v-shaped extension/diagonal structure) features can be planar sheets, alternately including perforations (e.g., mimicking structural voids or structural steel assemblies). Alternately, the support structure can have the diagonal extend between an extension down from the inner wall to an extension down from the outer wall, e.g., as shown in FIG. 10A.

In flat tracks (see FIG. 2) intended, e.g., for lying across horizontal planar surfaces (e.g., tables and floors), the track path channel (walls and path) can include additional layers for strengthening and stiffening. For example, additional layers of sheet material can be provided along the walls and under the path. One or more path bottom layers 18 can be located beneath the path sheet. The bottom layers can include a layer adhered to the path for stiffening, and/or a bottom layer at least partially free from the path, e.g., providing a slot therebetween to receive a track connector adapted to connect and align a pair of tracks end to end.

Figure 3C:
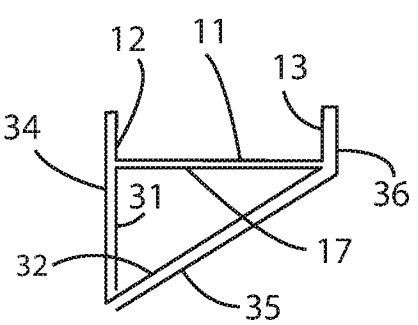
FIGS. 3A to 3C are cross-sectional views of tracks intended for wall mounting.
Figure 3B:
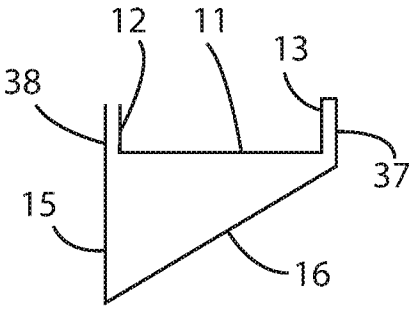
Figure 3A:
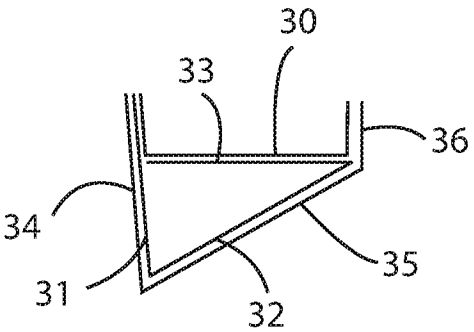

Track cross-sections can describe key features of many of the unique track options. Exemplary cross-sections of wall mount tracks are shown in FIGS. 3A to 3C. Tracks similar to that of FIG. 1 can be assembled from sheets with cross-sections like these. Note that any of the track designs described herein can be made available in unassembled, partly assembled or fully pre-assembled form.

In FIG. 3A, the structure can be assembled from three separate creased and folded sheets. The top channel sheet 30 provides the inside walls and path of the track. The inner bottom triangle sheet is folded to provide a strong triangular structure including an inner extension 31, inner diagonal 32, and a path bottom (inner path) 33. Alternately, the bottom support structure comprises an angular feature of the diagonal and extension of the second wall, and the diagonal reaches to an extension 103 down from the first wall (e.g., as shown in FIG. 10A). A third outer structure sheet can add strength and help to unify the structure. For example, the third sheet can include an outer first wall/extension 34, an outer diagonal 35, and an outer second wall layer sheet. Where sheets lie in parallel planar contact, they can be laminated together, e.g., with an adhesive or tabs. Optionally, any two of the three described sheets can be folded from a single sheet without a cut edge.

In FIG. 3B, the structure can be assembled from a single sheet of creased and folded planar stock. The top channel can be formed from a first sidewall 12, path sheet 11, and second wall 13. The sequence of zones, clockwise (shown here) or counter clockwise from the channel structure to provide an outer second wall 37, diagonal 16, extension 15, and outer first wall 38. Where sheets lie in parallel planar contact, e.g., between inner and outer walls, they can be laminated together, e.g., with an adhesive. In the embodiment of FIG. 3B, extension, diagonal and path are not laminated, so it may be appropriate to employ thicker and/or stronger sheet stock in the manufacture.

In FIG. 3C, the structure is similar to that of FIG. 3A, but it can be assembled from less than three sheets of material. In FIG. 3C, the structure is assembled from a single sheet of material wherein the material sheet edges begin and end at the intersection of the diagonal and extension structures. Note that applicable structural element sequences can be circular as a practical matter and the sheet can begin and end at any intersection, or even between intersections. In FIG. 3C, the sheet of material is creased and folded so that each structural element receives a bilaminar final structure. The structural elements can be provided in planar zones foldable into a structure having the cross-section of the Figure. For example, the zones can include an outer diagonal 35, outer second wall 36, inner second wall 13, path 11, inner first wall 12, outer first wall and extension 34, inner diagonal 32, inner (bottom) path 17, and inner extension 31. Where sheets lie in parallel planar contact, they can be laminated together, e.g., with an adhesive. For example inner and outer structure laminations can be fixed to each other, e.g., by adhesive.

Figure 6A:
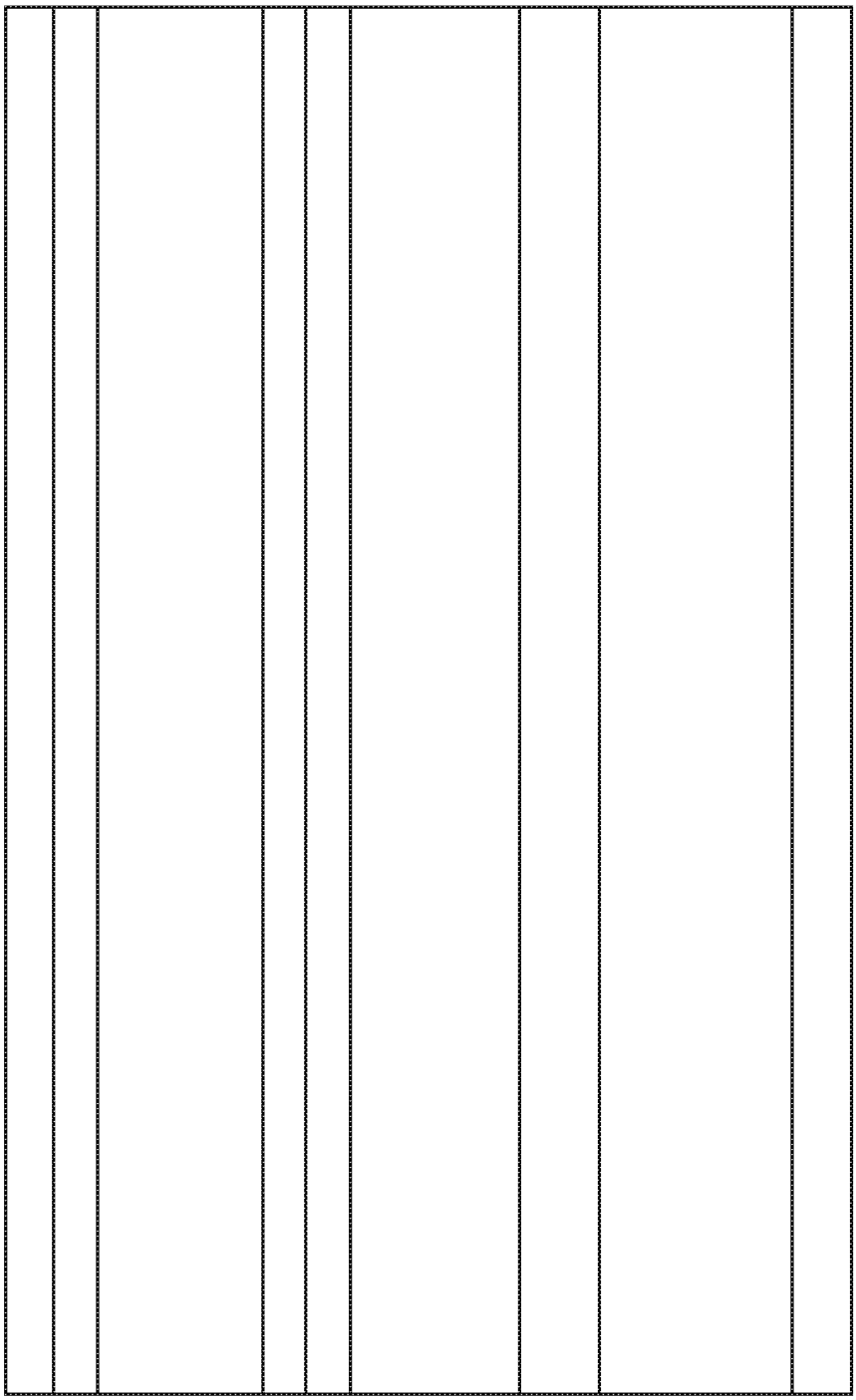
FIGS. 6A to 6C are schematic diagrams showing how two sheets of material can be folded and glued to provide a sturdy track for wall mounting. The FIG. 6A sheet of planar material has rectangular zones identified with fold lines directing folds for preparation of a track. The FIG. 6B sheet provides an outer wrap around structure to further strengthen and stiffen the track.
Figure 6B:
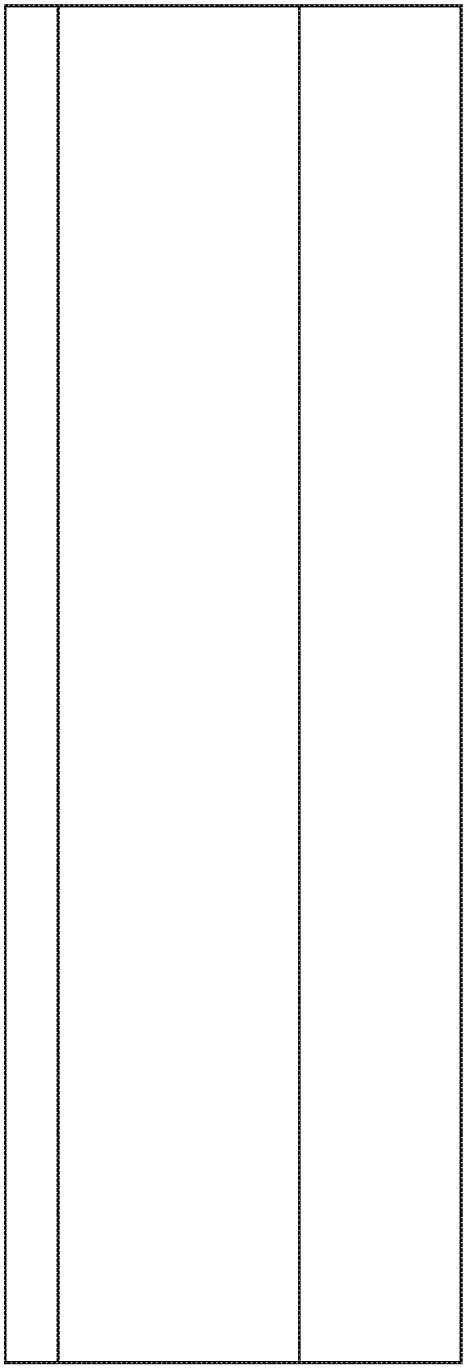
Figure 6C:
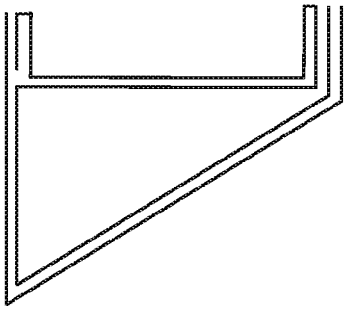

In still another embodiment, wall-mounted tracks can be assembled using two sheets of material. For example, a track structure of a path channel and triangular support structure can be laid out and folded, as shown in FIGS. 6A and 6C. To enhance the strength and stiffen the track, the outer surfaces of the initial track structure can be clad in an outer layer, e.g., as shown laid out in FIG. 6B, and applied according to the cross-section shown in FIG. 6C.

In tracks intended for lay out on a horizontal plane (e.g., as shown in FIG. 2), the track path channel (walls and path) a substantial wall mount and diagonal support structure are not necessary. The track channel can be strengthened with laminations of sheet layers (e.g., inner and outer), and laminations can be provided to receive connectors to connect and align pairs of track segments.

Figure 4C:
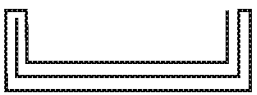
FIGS. 4A to 4C are cross-sectional views of tracks intended for free strung and flat horizontal surface mounting.
Figure 4B:
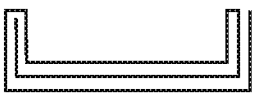
Figure 4A:
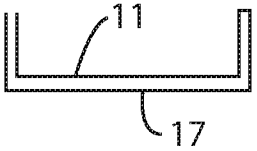

Examples of flat tracks are shown in FIGS. 4A to 4C. They are essentially channel structures for laying in series along a substantially horizontal surface to provide a track channel for rolling of toy cars. The laminations of the track structures can be seen in the cross-sections. The laminations can increase stiffness and provide slots to receive track connectors.

The relatively simple track of FIG. 4A can be made from a single sheet of planar material, or a pair of sheets laminated together. Preferably the inner and outer walls are laminated together with an adhesive. Typically, the path 11 and bottom 17 have at least an unlaminated subregion where they are not stuck together, leaving a slot to receive a connector. In one embodiment, the track of FIG. 4A, is fabricated by folding a sheet of material to provide zones of first inner wall, upper path, inner second wall, outer second wall, bottom path, outer first wall. Typically, inner and outer walls are fused together, while at least the path layers near the track ends are separate to provide a connector slot. Note, the single sheet laminated design allows one-sided printing to cover all visible surfaces.

The flat tracks can have channel dimensions the same or similar to those described above with regard to the tracks intended for wall mount. In a preferred embodiment, the track walls are about 1 cm high, and the path about 3.3 cm wide. It is possible, e.g., by appropriately adjusting track width and wall height, to provide material for two tracks from a single standard sheet of paper or card stock using this track configuration. For example, a double layered track can be fabricated from one half a sheet of standard paper (e.g., A4 or 8.5×11) stock wherein the walls are about 1 cm high and the track about 3.3 cm wide.

Regarding the track cross-section of FIG. 4B, a triple laminated track can be assembled by allocating zones in the order middle first wall, middle path, middle second wall, inner second wall, path top, inner first wall, outer first wall, bottom path, outer second wall. The space between the middle path and top and/or bottom can be left unfused, e.g., to provide a slot for a connector.

Regarding the track cross-section of FIG. 4C, a triple laminated track can be assembled by allocating zones in the order middle first wall, middle path, middle second wall, outer second wall, path bottom, outer first wall, inner first wall, top path, inner second wall. The space between the middle path and top and/or bottom can be left unfused, e.g., to provide a slot for a connector.

Curved Track.

Figure 9:
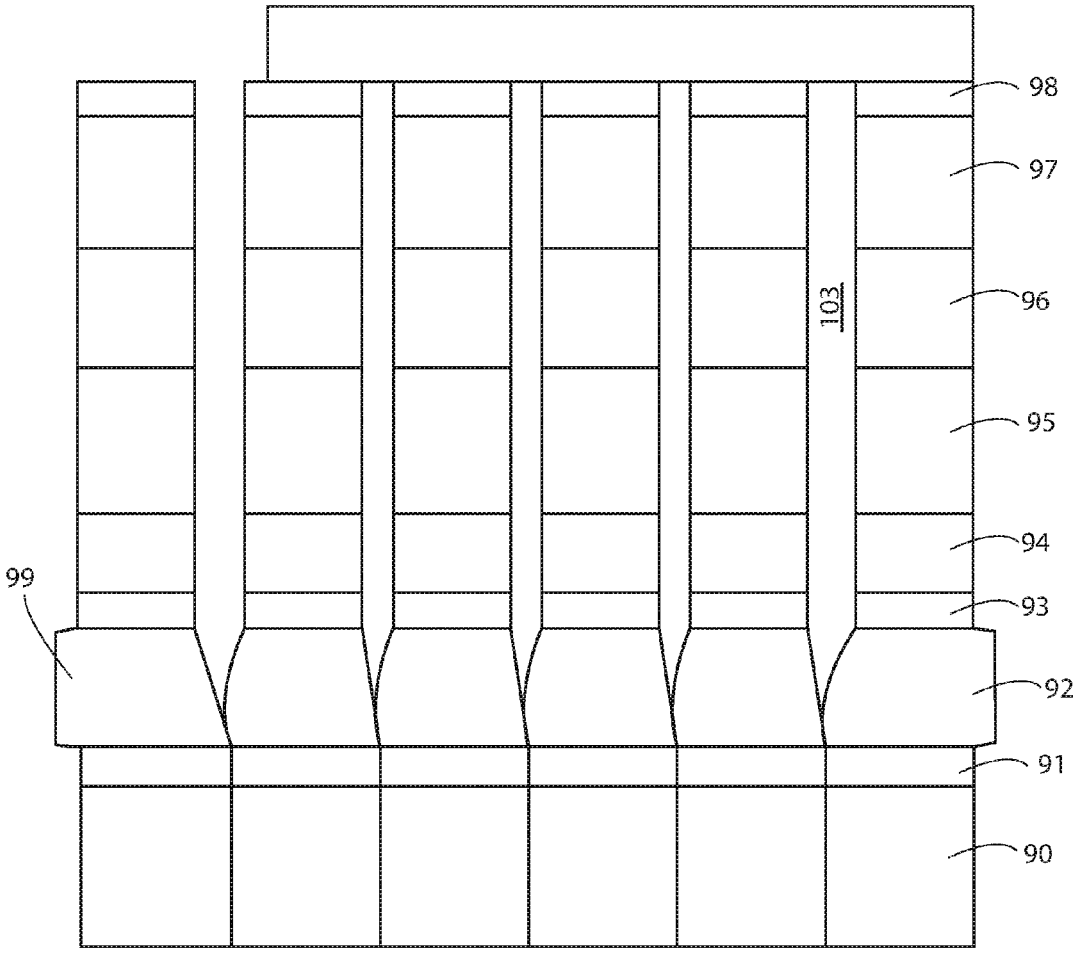
FIG. 9 shows an exemplary flat sheet pattern that can be have voids removed and folded to provide a curved track section.

A curved track can be presented as a flat sheet (e.g., punched from a sheet of card stock) that can be folded to provide a road bed that can be mounted in a room corner so that a car can race from a first wall to a second wall. For example, the unfolded track can include, e.g., in order a first wall extension 90 (comprising the first outer wall), a first side inner wall 91, path 92 (road bed, e.g., with cut-aways 103 allowing for nesting of consecutive road sections), inner second wall 93, outer second wall 94, diagonal 95, and an inner first wall extension 96, as shown in FIG. 9. The curved track can be further strengthened by continuing with an inner path bottom section 97 and a further extension 98 for lamination with the first wall or first wall extension. The road bed (path) can have path tabs 99 at one or both ends to cross gaps between consecutive track pieces.

In certain embodiments the folded segments can be maintained in position using a tab/slot arrangement. For example, one or more of the first wall extensions can have one or more tabs for insertion into a corresponding slot at the folded intersection of the diagonal and the first wall extension. See, e.g., FIG. 7.

To help retain the curved track (or, optionally, straight track) in the folded condition, adhesive material can be located on the surfaces where the inner first and second walls contact their outer walls. For example, there can be adhesive where the inside (not visible when assembled) of the first inside wall surface contacts the first wall extension; and/or where the inside of the second inner wall surface contacts the outer second wall.

To further strengthen the walls on the inside of the curve, a band of material (e.g., card stock) can be applied (e.g., using adhesive) along the outer second wall segments to help retain nested road bed sections together and hold the foreshortened outer walls so they continuously abut. See, e.g., FIG. 10B.

The assembled curved track can be mounted to walls in the corner of a room using an adhesive located on the ends of the first wall extension.

To prepare a curved track section, a road bed can be prepared with a longer length on one side over the other. For example the road bed (path) about the outside of the curve can be longer than the length of the inside of the curve. The wall on the outside of the curve can be longer than the wall on the inside of the curve. To prepare the track from a flat piece of stock, the folding can allow for material on the inside of the curve to be gathered or removed. For example, the path and wall toward the inside of the curve can be progressively eliminated or folded out of the way, e.g., using cuts and overlaps, cut outs, pleats, bunching, and/or the like. The overlaps or folds are preferably adapted to have any overlap folds or tabs directed in the direction of car travel, e.g., so that the car wheels can drop off the transition instead of encountering a raised protrusion.

In some embodiments, the path can slope down laterally toward the inside of the curve, e.g., to help the road bed carry more of the vectors of force turning a car, with less lateral slippage. The slope can be provided, e.g., by merely twisting the track, e.g., pulling down the track bed on the entry of the curve. In preferred embodiments, the slope can be provided by adjusting the geometry of the track cross section. For example, a shortened diagonal or lengthened second wall extension can reposition the road bed to be lower on the inside of the curve for the assembled track.

Figure 10B:
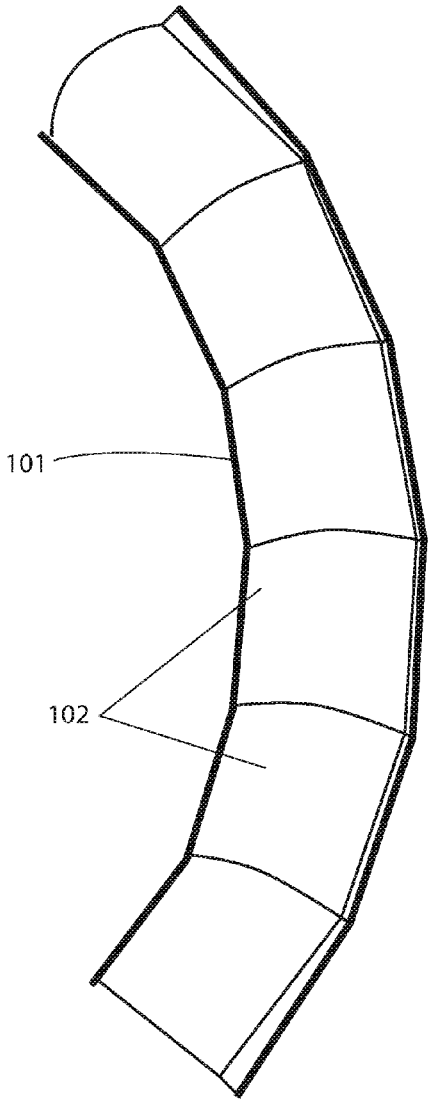
Figure 10C:
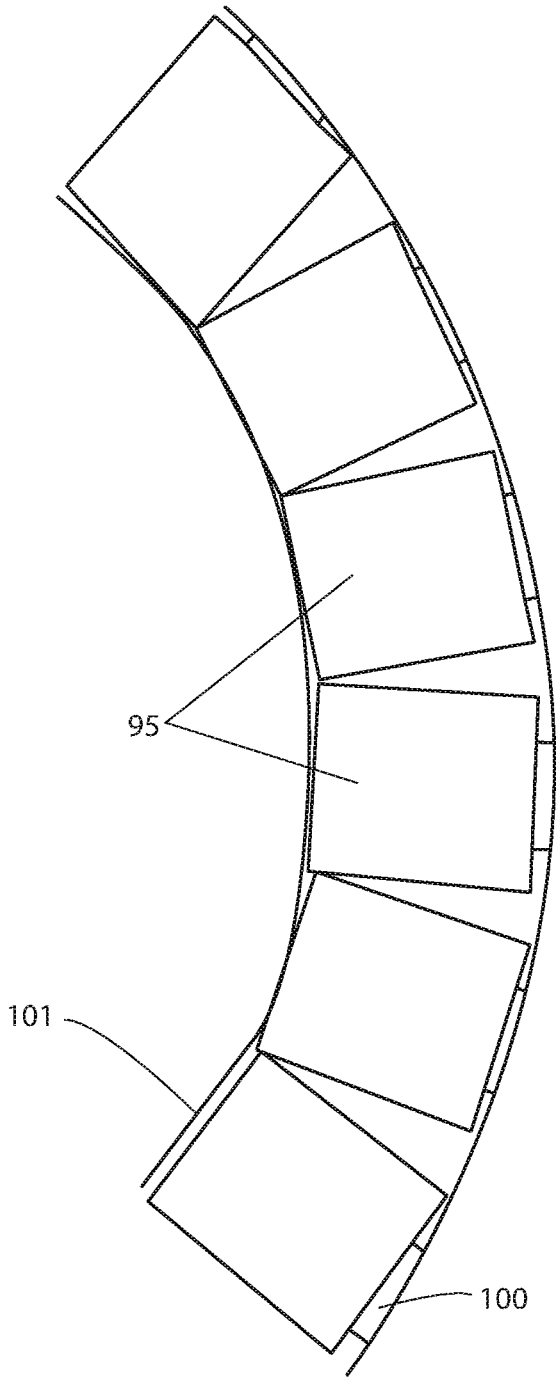

FIGS. 10A to 10C show an exemplary curved track in folded assembled condition. FIG. 10A shows a cross-sectional (or end on) view. Presented are the first wall with extension 90, a first side inner wall 91, path 92, inner second wall 93, outer second wall 94 with extension, diagonal 95, and an inner first wall extension 96. Note tab 100 extending from extension is inserted into the intersection of the diagonal, and an inner first wall extension, through a slot (not shown). The segments of the first wall are held in abutted association with each other with an adhesive strip 101. FIG. 10B is a top down view of an assembled curved track. Note how path segments 102 are nested one on top of another at their edges to allow the curvature resulting from the second walls (on the inside of the curve) being shorter than the first walls (on the outside of the curve). FIG. 10C shows a bottom view of the assembled curved track, with diagonals 95 receiving tabs 100 in slots at the outside of the curve and second walls being held on abutted association with adhesive strip 101.

It is notable that the curved track embodiments can have any of the track cross sections discussed above with regard to the straight track sections. For example, the cross sections of FIGS. 1, 2, 3, 4, 6 and/or the like.

Materials.

The tracks described above can be fabricated from planar sheets of material. For example, the sheets can be made of paper, plastic, metal, and/or the like. It is preferable that the material is capable of readily taking on a crease or fold. It is preferable that the sheets are compatible with common printing techniques. For example, in many embodiments, the planar sheets are commonly available paper, foil, or plastic sheet stock.

Adhesives can be useful in the assembly and mounting of the tracks. For example, sticky adhesives, such as, e.g., two-sided tape, rubber cement, or glue, can be used to adhere adjacent surfaces (such as, e.g., inner and outer walls). In many cases the tracks of the inventions may not require adhesives (with zones held in place with folds and/or tabs). However, adding adhesives to laminations can substantially enhance the stability and strength of the tracks. Alternately, laminations can be stabilized with fittings known in the art, such as, e.g., loop and hook, staples, clips, stitches, and/or the like. Optionally, laminations can be stabilized by slot/tab and/or push tab features, described below.

For mounting tracks, e.g., to room walls, any appropriate means can be employed. In preferred embodiments, releasable adhesives can be employed, such as, e.g., GLUDOTS or COMMAND STRIP. Alternately, tracks can be mounted to walls using tape, two-sided tape, tacks, staples, magnets, loop and hook, screws, and/or the like. In a particular embodiment, the track includes one or more magnets at the first wall and/or extension for mounting the track on a metal wall subject to magnetic attraction.

Accessories.

The present tracks can be used alone or in combination with additional track and features. For example, the present tracks folded from sheets can be connected to generic tracks. Alternately, features such as jumps and loops, can be constructed out of the sheet materials.

The present tracks can include slots (as described above) to receive track connectors. The track connectors can simply be shims or biscuits that insert into the distal end slot (e.g., between path layers) of a first track and also into the proximal end slot of a second track. In some embodiments, the connectors are generic track connectors and the slots are dimensioned to functionally cooperate. Typical connectors range in length between about 2 and 8 inches or about 4 inches. The connectors are typically no wider than the path width. The connector ends can be tapered top and bottom, and/or laterally, to facilitate insertion and swedging into the track slots.

The present tracks can be compatible with other toy accessories, such as jumps, curves, and loops. That is, e.g., the tracks can be adapted to receive connectors of other commercially available accessories, with slots to receive their connectors. Alternately, accessories can be fabricated from sheet material, as known in the art, e.g., origami techniques. For example, curves can be made from sheets by angular pleating techniques.

Kits for Making Tracks

Kits for constructing toy vehicle tracks can include planar sheets laid out with folding information and adhesives for adhering laminations and for mounting the tracks on a room wall. The sheets can be printable stock, and the kit can include one or more designs for printing desirable patterns on the sheets.

Figure 5:
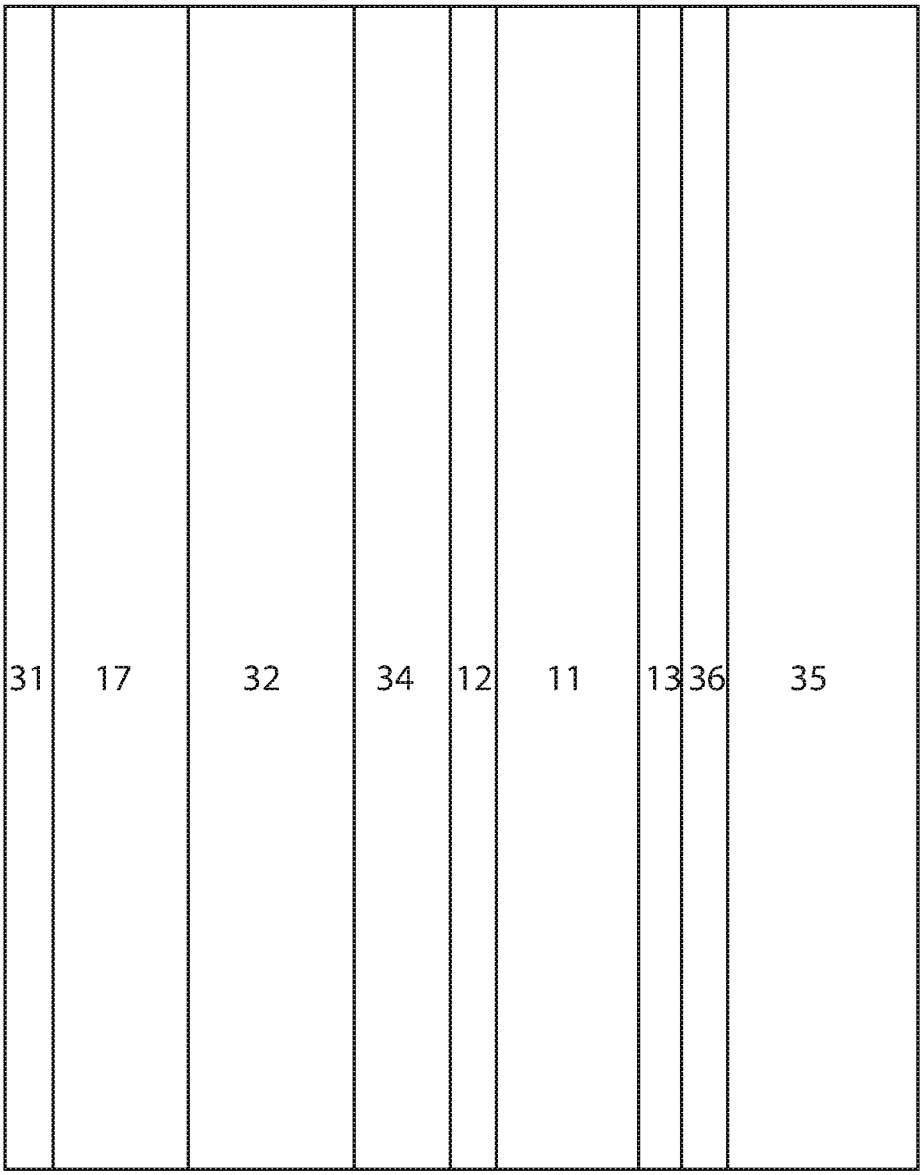
FIG. 5 is a schematic diagram showing a sheet of planar material with rectangular zones identified with fold lines directing folds for preparation of a wall mount track.

The planar sheets for fabrication of tracks can include zones, as described above. The zones typically represent planar members of a track structure, punctuated with folding lines. For example, a track described by the cross-section of FIG. 4C can be fabricated from a planar sheet laid out with the following zones, as shown in FIG. 5: outer diagonal 35, outer second wall 36, inner second wall 13, path 11, inner first wall 12, outer first wall and extension 34, inner diagonal 32, inner (bottom) path 17, and inner extension 31. To prepare such a structure from a standard piece of 8.5×11 paper, folds between zones would be made with zone widths of approximately 4.25 cm, 1 cm, 1 cm, 3.5 cm, 1 cm, 2 cm, 4.2 cm, 3.5 cm and 1 cm, respectively. Such a sheet could have lines drawn on the surface to identify the location of folds. Alternately, the lines between zones could be pre-creased by a mechanical folding, crushing, perforation, surface cutting (scoring), or embossing technique to facilitate accurate folding and to suggest the direction of folding assembly. The preceding is intended as an example only.

Similar track sheets can be laid out with variants based on the present Figures and descriptions above. For example, the dimensions of any structure feature can be adjusted, as desired. The walls can be shorter or longer. The extension can be taller or shorter, e.g., with corresponding adjustments of diagonal length to retain desired structural intersections. Alternately, the sheets can be laid out with zones corresponding to the examples presented in the Figures.

Note, although the example above starts at the sheet edge with the outer diagonal, the sheet may alternately start with a different zone, or the edge can start within the cross-sectional range of any particular feature. For example, the order of zones could be inner path, inner extension, inner diagonal, outer second wall, inner second wall, path, inner first wall, outer first wall, outer extension, and outer diagonal.

In more generic aspects, the track sheets for wall tracks could be laid out wall track with 6 zones (e.g., FIG. 3B) or 9 zones (FIG. 3C) with the same or different proportions. In certain embodiments, a 6-zone wall track can have the relative dimensions of 1 unit for inner and outer sidewall zones, path zones greater than 1 unit width, diagonal widths greater than the path zone width, and the extension zone varying in width to functionally link the first wall with the diagonal. For example, 1) the outer second sidewall, inner second sidewall, inner first sidewall, outer first sidewall can have a relative width dimension of about 1 unit; 2) the diagonal can have a relative width dimension ranging from about 4 to 5.2 units; 3) the path can have a relative width ranging from about 3 to 4 units; and, 4) the extension can have a relative width ranging from about 1.5 to 3 units. Of course, this embodiment is for example only and other relative dimensions can be practiced in light of the disclosures herein. In certain embodiments, the units are centimeters. For nine-zone sheets, the second path, extension, or diagonal feature can be similar in dimensions to those of a 6-zone sheet, but with minor adjustments, to make up for slight differences related to, e.g., the additional distance around an outer corner versus an inner corner of folds.

For flat track (e.g., floor supported, or dangled) embodiments, there are typically 6 or 9 zones. For example, see FIGS. 4A to 4C. As with the wall-mounted tracks, the walls generally have a relative height of about 1 unit, and the path about 3.5 units. For example, 1) the outer second sidewall, inner second sidewall, inner first sidewall, outer first sidewall can have a relative width dimension of less than about 1 unit; and, the path, inner path (and optional middle path) can have a relative width ranging from about 3 to 4 units. With regard to generic scale track cars, the units are typically centimeters.

In one embodiment, flat tracks can be laid out with two track segments on a single standard size sheet. For example, a track of FIG. 4A can have a pair of tracks laid out, each taking up one half of the sheet. Assuming 8.5×11 paper (27.75 cm wide), a double layered track with a 3.5 cm path and 1 cm walls would take about 11 cm of paper width. Two such tracks would use 22 cm, leaving about 5 cm for additional wall height, another path layer, another wall lamination, or side skirts to one or both tracks. For example, a single standard sheet could provide material for one track of cross-section 4A and one of 4B or 4C.

The kits can include adhesive. Where sheets lie in parallel planar contact, they can be laminated together, e.g., with an adhesive. The adhesive can be used to bind together abutted features, e.g., surface contacts between parallel planar sheet zones. In one aspect, the adhesive can be applied from a glue dispenser. Alternately, adhesive could be applied during a printing process, as described below. In many embodiments, there can be benefits to gluing together adjacent inner and outer walls, inner and outer diagonals, inner and outer extension, and certain parts of inner and outer path (often leaving avoid to receive track connectors).

The adhesive can be permanent, or releasable. Typically the adhesive to hold together the folded track is permanent. Alternatively, the adhesive between track zones can be releasable, so the track can be unfolded. In most embodiments, releasable adhesive is used on the outer surface of the first wall and/or extension of the first wall for wall mounted track segments.

Kits can be stored or shipped in boxes. The boxes themselves can include a track layout that can be released from the box material and folded into one of more track sections, as discussed below.

A major benefit of the present tracks fabricated of planar sheets is the ability to print desired patterns and indicia on the sheets before folding them. The sheets can be compatible with printers, such as, e.g., ink jet printers and laser printers. Standard graphics software can be used to design visual presentations, e.g., for the parts of the tracks that will be visible in use. For example, the path top can be printed with a roadbed design, e.g., road strips, man holes, and/or the like. Sidewalls can include graphics appropriate for a racetrack, or highway. Bottom sections can include, e.g., graphics depicting structural elements, such as beams or bulkheads. The kit can include software with templates for predesigned tracks, or allowing users to design their own track sheets for printing. The templates can include alternate zone width indicators to direct folding for tracks with any number of alternate cross-section structures.

Methods of Preparing a Toy Vehicle Track

Toy car tracks can be made according to the methods and materials described herein. Planar sheets of appropriate material can be provided with lines or creases indicating how the sheets may be folded to provide the desired track. The methods can include printing designs on the sheets and gluing together certain surfaces of the folded sheets. Generally, tracks can be made by selecting sheets, printing designs on the sheets, folding the sheets, gluing the sheets, connecting the resultant track segments together, and mounting them at a desired location.

The planar sheets can be as described above. Sheets can be standard paper stock. The sheets can be segmented into typically rectangular zones (though diverging zones may be employed, e.g., on a track intended as a landing ramp for a jump). The segmenting of zones can be according to, e.g., written instruction, fold indicator lines, or lines weakened in the sheet by creases, perforations, or the like.

The sheets can optionally be printed, e.g., using commonly available printers, as discussed above. The printing can direct where to fold the sheets to form track structures. Optionally, the printing can include graphics on surfaces observable on the completed track segment. The printing ink can include certain beneficial properties such as strengthening and water proofing character.

The sheets can be folded into track sections. Typically, the track sections are folded by hand. This can be educational and entertaining. Optionally, folding can be accomplished using specialized equipment, e.g., similar to a box and pan brake. Folds can be at any appropriate angle. Many features, such as a transition between inner and outer walls can include a 180° fold. Also common in the track features are about 90° or more corners between zones, e.g., walls and paths.

To strengthen and stabilize the folded track segments, adhesives can be used to hold the structural elements in place. As described above, it is often beneficial to adhere together elements that come in contact at their planar surfaces, such as inner and outer walls, path layers, diagonals, and extensions. Depending on where the sheet edges start and end in a particular design, it can be beneficial to include a line of glue to fix the edge in place.

Once two or more track segments have been assembled, they can be interconnected to provide longer roadways for the toy cars. Often the interconnection is accomplished using a track connector running between slots in the roadway of adjacent track segments. Alternately, there is not a connector, but the track segments are aligned and held in place by double back tape, floor mounts, and/or wall mounts (e.g., as simple as double sided tape, due to the light weight of the track structures) and/or the like). The tracks may have path extensions that overlap, excluding any gap in the path between track sections. In many embodiments, there are no additional wall mount structures, with mounting of track directly using adhesive between the wall and track. For example, the present wall mounted track sections are typically mounted to a wall using a releasable adhesive on the outer wall and/or extension surfaces.

Note any of the tracks of kits can also be provided with partly pre-assembled or fully assembled track segments. Track with different amounts of prefabrication can be made available to expedite the paper tracks construction process or to suit users in different age groups.

EXAMPLES

The following examples are offered to illustrate, but not to limit the claimed invention.

Example 1—Track with Assembly Aids

An easy assembly straight track has been designed, e.g., with pre-creased fold lines, alignment slot/tab features, prepositioned adhesive, positioning/anti-shear push tabs, and path extensions to eliminate gaps between consecutive track sections.

Figure 7:
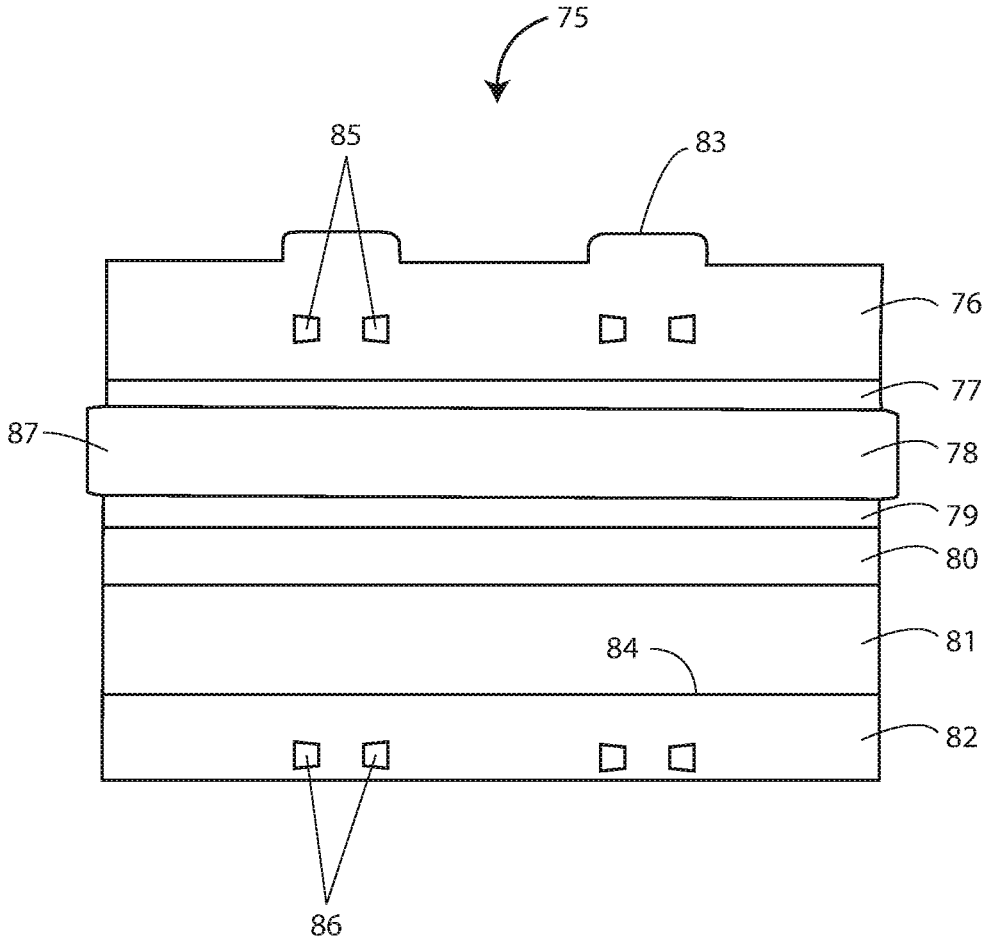
FIG. 7 shows a front side of a track before folding. Note that tracks include tabs, punch through anti-shear connectors, and zones for application of adhesive.

Track 75 as flat media before folding is shown in FIG. 7. The track zones include the first wall extension 76, inner first wall 77, path 78, inner second wall 79, outer second wall 80 (with optional extension feature), diagonal 81, and inside first wall extension 82.

Note the tabs 83, adapted to insert into slots 84 on assembly. In addition, first push tabs 85, can be aligned with second push tabs 86 on assembly. When push tabs are pushed through, they pivot at the uncut side providing a void for the second aligned push tab to enter; creating a link that prevents their planar zones from delaminating or shearing tangentially past each other.

The back sides of the inner walls can include adhesive to permanently or semi permanently laminate the respective inside walls to their outside walls. Optionally, the adhesive can be applied to the back side of the inner walls (and/or back sides of the upper outer walls) and covered with a removable strip that prevents adhesion of surfaces until the strip is removed.

The track includes path extensions 87 to traverse any gaps that may exist between consecutive track sections, e.g., when applied to a wall of a room. It is usually preferred the extension of the uphill track section overlap the extension of the downhill section.

Example 2—Assembly of a Flat Track

The flat (or curved) tracks of the invention can be assembled with sequential folding, tab alignments and pressing of adhesives, as shown, e.g., in FIGS. 8A to 8G.

The flat track blank includes tabs, push tabs, double sided tape, and pre-creased fold lines, as discussed above.

Figure 8A:
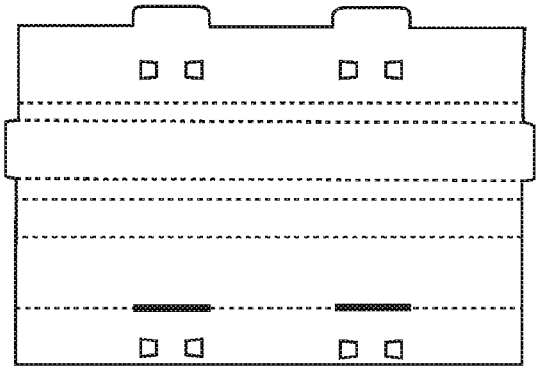
FIGS. 8A to 8G show a sequence of assembly for an exemplary straight track.
Figure 8B:
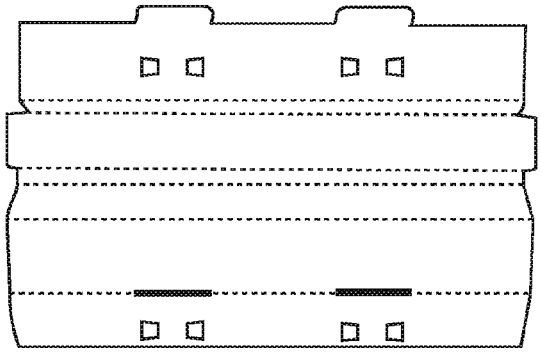
Figure 8C:
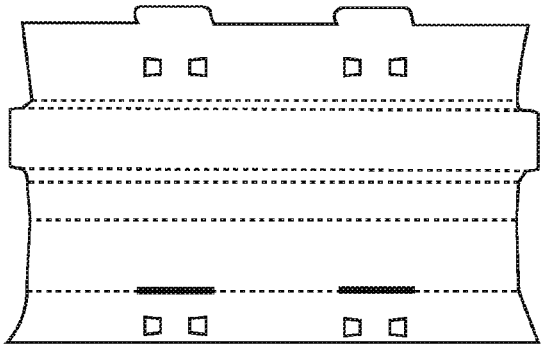
Figure 8D:
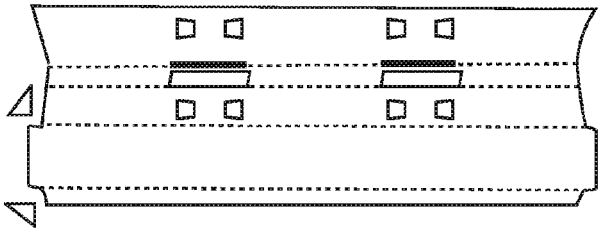
Figure 8E:
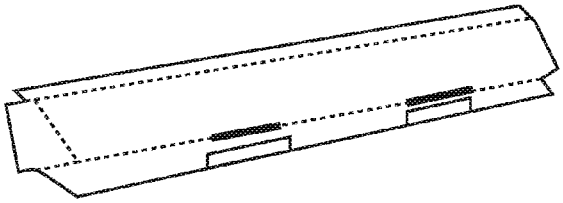
Figure 8F:
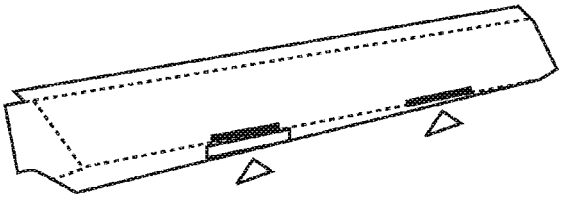
Figure 8G:
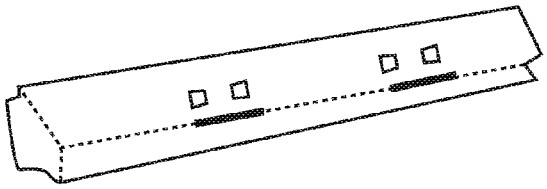

In FIG. 8A, the un-folded track is laid out with the back side oriented up and the front (e.g., visible, indicia printed) side down. Double sided tape is applied to positions aiding in lamination of the first wall extension to the inside inner wall extension.

At 8B, the track is partially pre-folded so at the creases between inner walls and path bringing them closer together on the front side and other zones are folded at creases to bring them closer together on the back side.

At 8C, adhesive backing tape is removed to allow the inner walls to be adhered to the outer walls.

At 8D, the walls (rails) are formed by pressing the inner and outer walls together so they become laminated with the exposed adhesive.

At 8E and 8F, the track is folded into the final shape and tabs inserted into slots.

Finally, at 8G, the aligned push tabs are pushed through to the inside of the track so that the external push tab is locked into the void left by the removal of the inner push tab.

The track section is ready to stick to a room wall using double sided tape, e.g., on the outer surface of the outer first wall extension.

Example 3—Track Built into a Box

The tracks of the invention can be built into a box, e.g., to hold additional track for retail sale presentation, or as a "free gift" in the retail box of another product. An additional benefit is reuse and reduction of waste by continued use of the packaging material.

Many retail products for sale come in a box made of materials similar or the same as those compatible with the present tracks. The boxes can be adapted to include material ready to convert into a track, e.g., by printing, embossing, cutting, creasing, stamping, and/or perforating a track pattern of the invention onto the box.

Figure 11:
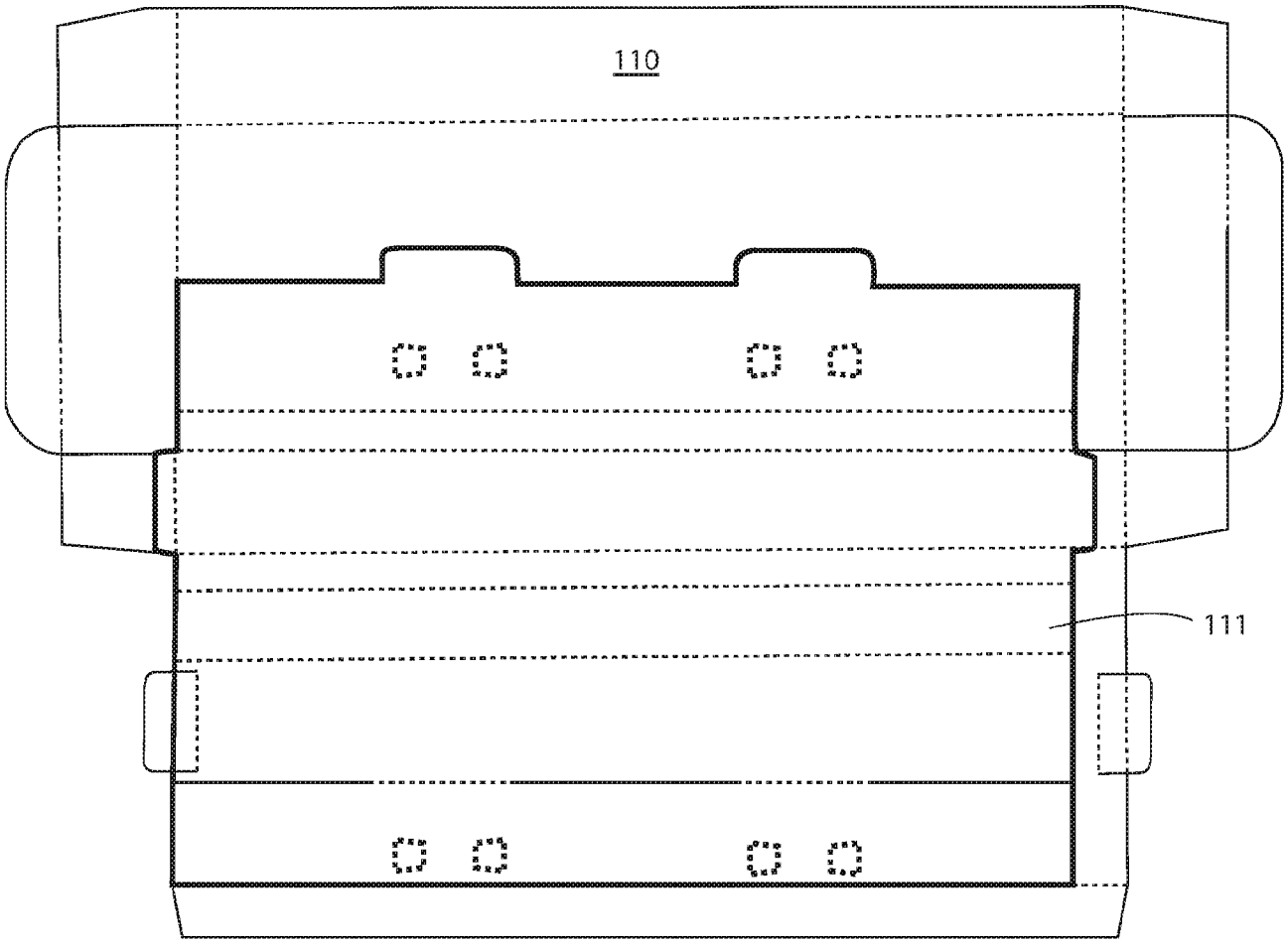
FIG. 11 shows a straight track flat layout featuring push tabs, slot/tab pairs, and adhesive zones. The track is incorporated into the same card board sheet adapted to fold into a box.

One example of this concept is provided in FIG. 11. Die stamped card sheet 110 is designed to be folded into a box. Incorporated into the design of the box are several common fold lines and edges between the box and track 111. For example the box has a depth the same as the track path width, and the box width is equivalent to the sum of the second wall, outer second wall, diagonal, and inside first wall extension put together.

The track can be merely printed onto the inside or outside of the retail box. To obtain the track, one can cut, e.g., along the bold lines, then fold along the indicated fold lines. Optionally, the external outline of the track can be perforated into the box for easy removal by tearing. Tabs and slots can be die cut but left in place.

Optionally, the features of the track design do not have to correspond with features of the box. For example, the track design can be provided on one flat side of the box (or on more than one side of the same box). The creases of the track are not required to correspond with creases of the box.

While the foregoing invention has been described in some detail for purposes of clarity and understanding, it will be clear to one skilled in the art from a reading of this disclosure that various changes in form and detail can be made without departing from the true scope of the invention. For example, all the techniques and tracks described above can be used in various combinations. All publications, patents, patent applications, and/or other documents cited in this application are incorporated by reference in their entirety for all purposes to the same extent as if each individual publication, patent, patent application, and/or other document were individually indicated to be incorporated by reference for all purposes.

What is claimed is:

1. A toy vehicle track comprising:

a path having a length dimension and a cross-section across the path length;

wherein the cross-section comprises:

a top channel cross-section comprising in order a cross-section of a first sidewall, the path, and a second sidewall, wherein the sidewalls are directed substantially perpendicular up from the path surface cross-section;

a bottom angle cross-section comprising the cross-section of the path, an extension down from the first sidewall, and a diagonal running from the extension to an intersection of the path surface and the second sidewall or sidewall extension;

wherein the extension down and diagonal interact with the top channel thereby providing support stiffening the track along the path length.

2. A track of claim 1, wherein the path surface cross-section perpendicular to the length is about 1.3 inches (3.3 cm).

3. A track of claim 1, wherein the length dimension is about 11 inches (28 cm).

4. A track of claim 1, wherein the vehicle path is fabricated from a paper sheet.

5. A track of claim 4, wherein the vehicle path is fabricated from an 8.5 by 11 inch or A4 sheet.

6. A track of claim 4, wherein the sheet comprises parallel rectangular zones in the order: diagonal, outer second sidewall, inner second sidewall, path surface, inner first sidewall, outer sidewall, extension; wherein the extension may be adjacent to the diagonal, and the start and end of the order can be between any two adjacent zones.

7. A track of claim 6, wherein the sheet further comprises the zones: inside diagonal, inner path, and inner extension.

8. A track of claim 4, wherein the sheet of paper comprises the zones in the order of: diagonal, outer second sidewall, inner second sidewall, path surface, inner first sidewall, outer first sidewall, extension, inside diagonal, inner path, and inner extension.

9. A track of claim 1, wherein the cross-section walls are about 1 cm high, the path about 3.3 cm wide, the extension from about 2 cm to 3.5 cm, and the diagonal about 4 cm to 5.2 cm.

10. A track of claim 4, wherein the sheet is pre-creased.

11. A track of claim 10, wherein the pre-creases are between any adjacent zones excluding the intersection between the outer first sidewall and extension from the first sidewall.

12. A track of claim 6, wherein the zones are adhered together at contact surfaces selected from the list consisting of: first outer wall/first inner wall, second outer wall/second inner wall, diagonal/inner diagonal, extension/inner extension, and path/inner path.

13. A track of claim 12, wherein the contact between the inner path and path is not adhered, and a track connector is inserted therebetween.

14. A track of claim 1, wherein the vehicle track further comprises a releasable adhesive on the outer surface of the first wall or on the extension of the first wall.

15. A kit for constructing a toy vehicle track, the kit comprising:

one or more planar sheets having a length greater than a width and comprising at least 6 parallel rectangular zones running along the length; wherein the zones are demarked by creases or lines; wherein a first rectangular zone (inner first sidewall) has a first width, a second zone (path) has a second width greater than the first width, third (inner second wall) and fourth (outer wall) widths are about the same as the first width, a fifth (diagonal) width is greater than the second width; and, a sixth (extension) width may vary in width to functionally link the first wall with the diagonal; and, an adhesive adapted to stick to a surface of the one or more sheets;

wherein when so functionally linked, the extension and diagonal interact with the top channel thereby providing support stiffening the track along the length.

16. The kit of claim 15, wherein the sheets are fabricated from paper, metal, or plastic.

17. The kit of claim 15, wherein the sheets have standard 8.5×11 or A4 paper dimensions.

18. The kit of claim 15, wherein the sheets include at least 6 rectangular zones including in order diagonal, outer second sidewall, inner second sidewall, path surface, inner first sidewall, outer sidewall, and extension.

19. The kit of claim 15, wherein: 1) the outer second sidewall, inner second sidewall, inner first sidewall, outer sidewall have a relative width dimension of about 1 unit; 2) the diagonal has a relative width dimension ranging from about 4 to 5.2 units; 3) the path has a relative width ranging from about 3 to 4 units; and, 4) the extension has a relative width ranging from about 1.5 to 3 units.

20. The kit of claim 15, wherein the sheets include 9 rectangular zones including in order diagonal, outer second sidewall, inner second sidewall, path surface, inner first sidewall, outer sidewall, extension, inside diagonal, inner path, and inner extension.

21. The kit of claim 20, wherein: 1) the outer second sidewall, inner second sidewall, inner first sidewall, and outer first sidewall have a relative width dimension of about 1 unit; 2) the diagonal and inside diagonal have relative width dimensions ranging from about 4 to 5.2 units; 3) the path and inner path have relative widths ranging from about 3 to 4 units; and, 4) the extension and inner extension have relative widths ranging from about 1.5 to 3 units.

22. The kit of claim 15, wherein the first and last listed zones are attached and the order of zones starts and ends at a line between any other pair of adjacent zones.

23. The kit of claim 22, wherein the first listed zone begins with a sheet edge and the last zone ends with a sheet edge.

24. The kit of claim 15, wherein the sheet comprises the creases between any adjacent zones excluding the intersection between the outer first sidewall and extension from the first sidewall.

25. The kit of claim 15, wherein the adhesive is on the sheets at contact surfaces selected from the list consisting of: first outer wall/first inner wall, second outer wall/second inner wall, diagonal/inner diagonal, extension/inner extension, and path/inner path.

26. The kit of claim 15, further comprising one or more track connectors adapted to connect a distal end of a first track to a proximal end of a second track.

27. The kit of claim 20, wherein a contact between the inner path and path is not adhered, providing therebetween a slot adapted to receive a track connector.

28. The kit of claim 15, further comprising a releasable adhesive on the outer surface of the first wall or extension of the first wall.

29. The kit of claim 28, wherein the releasable adhesive is a GLUDOTS™ or COMMAND STRIP™.

30. The kit of claim 15, further comprising software for designing indicia to be printed onto the sheets.

31. A method of preparing a toy vehicle track, the method comprising:

providing one or more planar sheets having a length greater than a width and comprising at least 6 parallel rectangular zones running along the length; wherein the zones are demarked by creases or lines; wherein, in order, a first rectangular zone (inner first wall) has a first width, a second zone (path) has a second width greater than the first width, third (inner second wall) and fourth widths are about the same as the first width, a fifth width (diagonal) is greater than the second width; and, folding the sheet along the creases or lines;

wherein when so folded the diagonal provides support stiffening the track along the length.

32. The method of claim 31, wherein 1) the outer second sidewall, inner second sidewall, inner first sidewall, outer sidewall have a relative width dimension of about 1 unit; 2) the diagonal has a relative width dimension ranging from about 4 to 5.2 units; 3) the path has a relative width ranging from about 3 to 4 units; and, 4) the extension has a relative width ranging from about 1.5 to 3 units.

33. The method of claim 31, further comprising printing indicia onto the sheet.

34. The method of claim 31, further comprising adhering the zones to each other at contact surfaces consisting of those defined as follows: first outer wall/first inner wall, second outer wall/second inner wall, diagonal/inner diagonal, extension/inner extension, and path/inner path.

35. The method of claim 31, further comprising adhering the track to a wall with adherent contact at the outer first wall or outer extension of the first wall.

36. A toy vehicle track comprising:

a path surface length dimension and a cross-section across the path length;

wherein the cross-section comprises:

a top channel cross-section comprising in order a cross-section of a first sidewall, the path, and a second sidewall, wherein the sidewalls are directed substantially perpendicular up from the path surface cross-section;

a bottom connector slot comprising the cross-section of the path surface, a continuation down from the first sidewall to below the path surface cross section, a continuation down from the second sidewall to below the path surface cross section, and a track bottom running from the bottom of the first and second continuations; and, a connector adapted to fit within the connector slot.

37. A curving toy vehicle track comprising:

a path having a length dimension and a cross-section across the path length;

wherein the cross-section comprises:

a top channel cross-section comprising in order a cross-section of a first sidewall, the path, and a second sidewall, wherein the sidewalls are directed substantially perpendicular up from the path surface cross-section;

a bottom angled cross-section comprising the cross-section of the path, an extension down from the first sidewall, and a diagonal running from the extension to an intersection of the path surface and the second sidewall, wherein the extension down and diagonal interact with the top channel thereby providing support stiffening the track along the length dimension; and, wherein the path comprises a series of segments shorter on one side providing a shorter length on the first sidewall than the second side wall, or shorter length on the second sidewall than the first side wall;

thereby providing a track with a curving path.

* * * * *